US007670150B2

(12) United States Patent
Hisamatsu et al.

(10) Patent No.: US 7,670,150 B2
(45) Date of Patent: Mar. 2, 2010

(54) LOW PROFILE BOARD-MOUNTED CONNECTOR

(75) Inventors: Kazuhito Hisamatsu, Tokyo (JP); Masaki Yamashita, Tokyo (JP); Takahiro Yamaji, Tokyo (JP); Tatsuya Shioda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/157,744

(22) Filed: Jun. 12, 2008

(65) Prior Publication Data

US 2009/0011623 A1 Jan. 8, 2009

(30) Foreign Application Priority Data

Jul. 3, 2007 (JP) ..... 2007-175518

(51) Int. Cl.
*H01R 12/00* (2006.01)

(52) U.S. Cl. ..... 439/79; 439/80; 439/607.37

(58) Field of Classification Search ..... 439/79, 439/80, 607
See application file for complete search history.

(56) References Cited

U.S. PATENT DOCUMENTS

| | | | | |
|---|---|---|---|---|
| 5,702,271 | A | 12/1997 | Steinman | |
| 7,182,610 | B2 | 2/2007 | Lin | |
| 2004/0097107 | A1 * | 5/2004 | Motojima et al. | 439/79 |
| 2004/0157491 | A1 * | 8/2004 | Lin | 439/607 |
| 2006/0121781 | A1 * | 6/2006 | Zhang et al. | 439/607 |
| 2006/0121782 | A1 * | 6/2006 | Shen et al. | 439/607 |
| 2006/0234530 | A1 * | 10/2006 | Chung | 439/79 |
| 2006/0292929 | A1 * | 12/2006 | Wei | 439/607 |
| 2007/0066136 | A1 * | 3/2007 | Kim | 439/607 |

FOREIGN PATENT DOCUMENTS

| | | |
|---|---|---|
| JP | 4-332485 | 11/1992 |
| JP | 2002-050441 | 2/2002 |
| JP | 2004-327244 | 11/2004 |

OTHER PUBLICATIONS

English translation of Japanese Office Action dated Apr. 23, 2009.

* cited by examiner

*Primary Examiner*—Hien Vu
(74) *Attorney, Agent, or Firm*—Collard & Roe, P.C.

(57) ABSTRACT

An electrical connector mountable to a circuit board is disclosed. The disclosed connector includes a shell which comprises a first plate-like portion, a second plate-like portion and connection portions. The first plate-like portion extends in a predetermined direction and is provided with fixed portions at opposite ends thereof in the predetermined direction. The fixed portion is to be fixed to the circuit board. The second plate-like portion extends in the predetermined direction. Each of the connection portions connects the first and the second plate-like portion. The second plate-like portion is provided with force resist portions at opposite ends thereof in the predetermined direction. The force resist portions are configured so that, when a force is applied to the electrical connector along a direction from the first plate-like portion towards the second plate-like portion, the force resist portions resist the force.

3 Claims, 3 Drawing Sheets

LOW PROFILE BOARD-MOUNTED CONNECTOR

CROSS REFERENCE TO RELATED APPLICATIONS

Applicants claim priority under 35 U.S.C. §119 of Japanese Application No. 2007-175518 filed Jul. 3, 2007.

BACKGROUND OF THE INVENTION

This invention relates to an electrical connector mountable to a circuit board of an electrical instrument or the like. In particular, the present invention relates to an electrical connector which is mounted on a circuit board, being disposed within a recess formed in the circuit board.

In order to reduce the height of an electrical connector mounted to a circuit board, a recess or opening is formed in the circuit board, especially, at an edge thereof, the electrical connector is being disposed within the recess. For example, the aforementioned electrical connector is disclosed in U.S. Pat. No. 5,702,271, U.S. Pat. No. 7,182,610, or JP 2004-327244 A, each of which is incorporated herein by reference in their entireties. Specifically, a shell of the electrical connector of JP 2004-327244 A has two fixed portions or two wings at opposite sides of the electrical connector; the fixed portions are soldered to the upper surface of the circuit board so that the electrical connector is secured to the circuit board.

However, the electrical connector of JP 2004-327244 A has a problem that its shell may be deformed by unexpected movement of a mating connector thereof. Therefore, there is a need for an electrical connector which has a better deformation resistant structure in comparison with the electrical connector of the JP 2004-327244 A.

SUMMARY OF THE INVENTION

According to one aspect of the present invention, an electrical connector mountable to a circuit board comprises contact pins, a housing holding the contact pins and a shell covering the housing at least in part. The shell comprises a first plate-like portion, a second plate-like portion and connection portions. The first plate-like portion extends in a predetermined direction and is provided with fixed portions at opposite ends thereof in the predetermined direction. The fixed portion is to be fixed to the circuit board. The second plate-like portion extends in the predetermined direction. Each of the connection portions connects the first and the second plate-like portion. The second plate-like portion is provided with force resist portions at opposite ends thereof in the predetermined direction. The force resist portions are configured so that, when a force is applied to the electrical connector along a direction from the first plate-like portion towards the second plate-like portion, the force resist portions resist the force.

An appreciation of the objectives of the present invention and a more complete understanding of its structure may be had by studying the following description of the preferred embodiment and by referring to the accompanying drawings.

Figure 1:
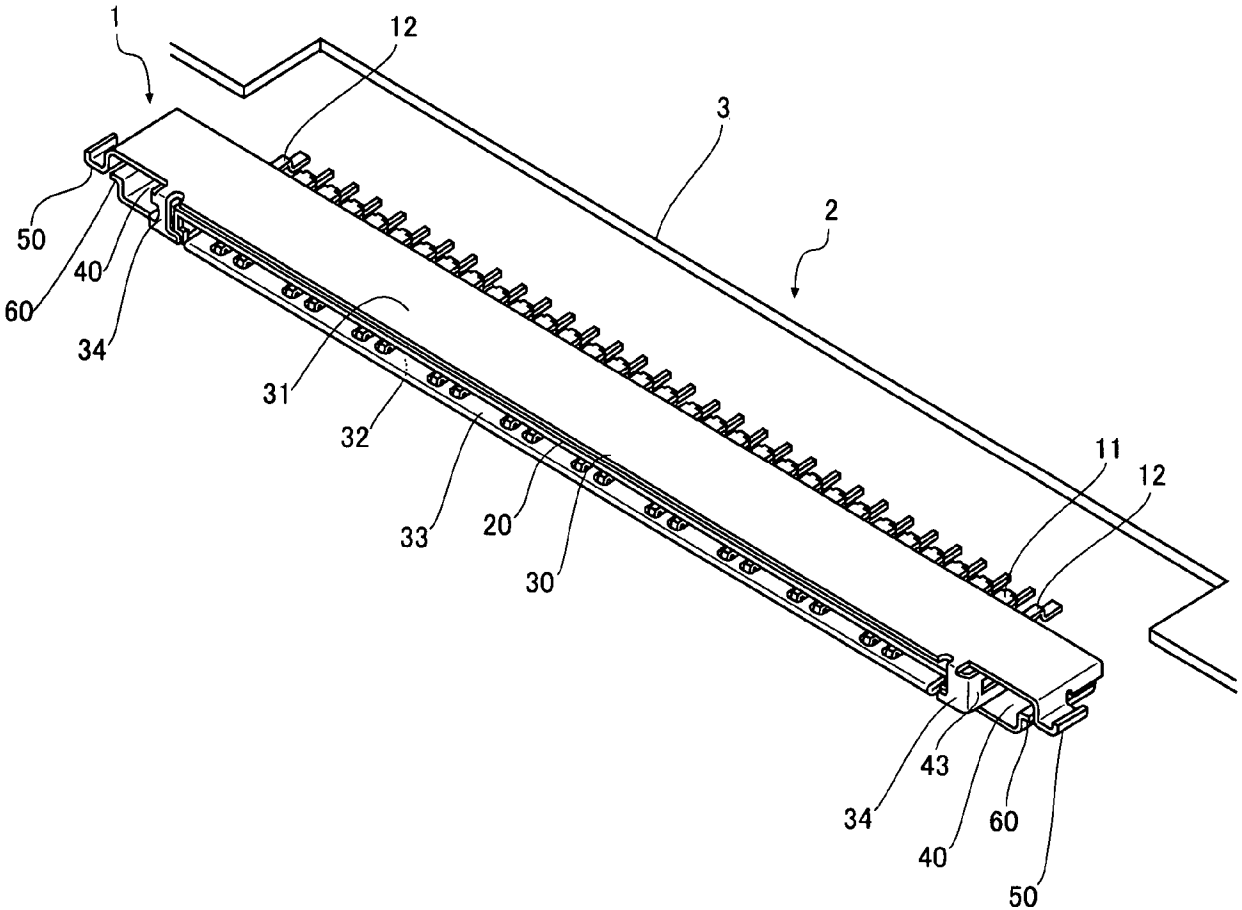
FIG. 1 is a front oblique view showing a connector and a circuit board in accordance with an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
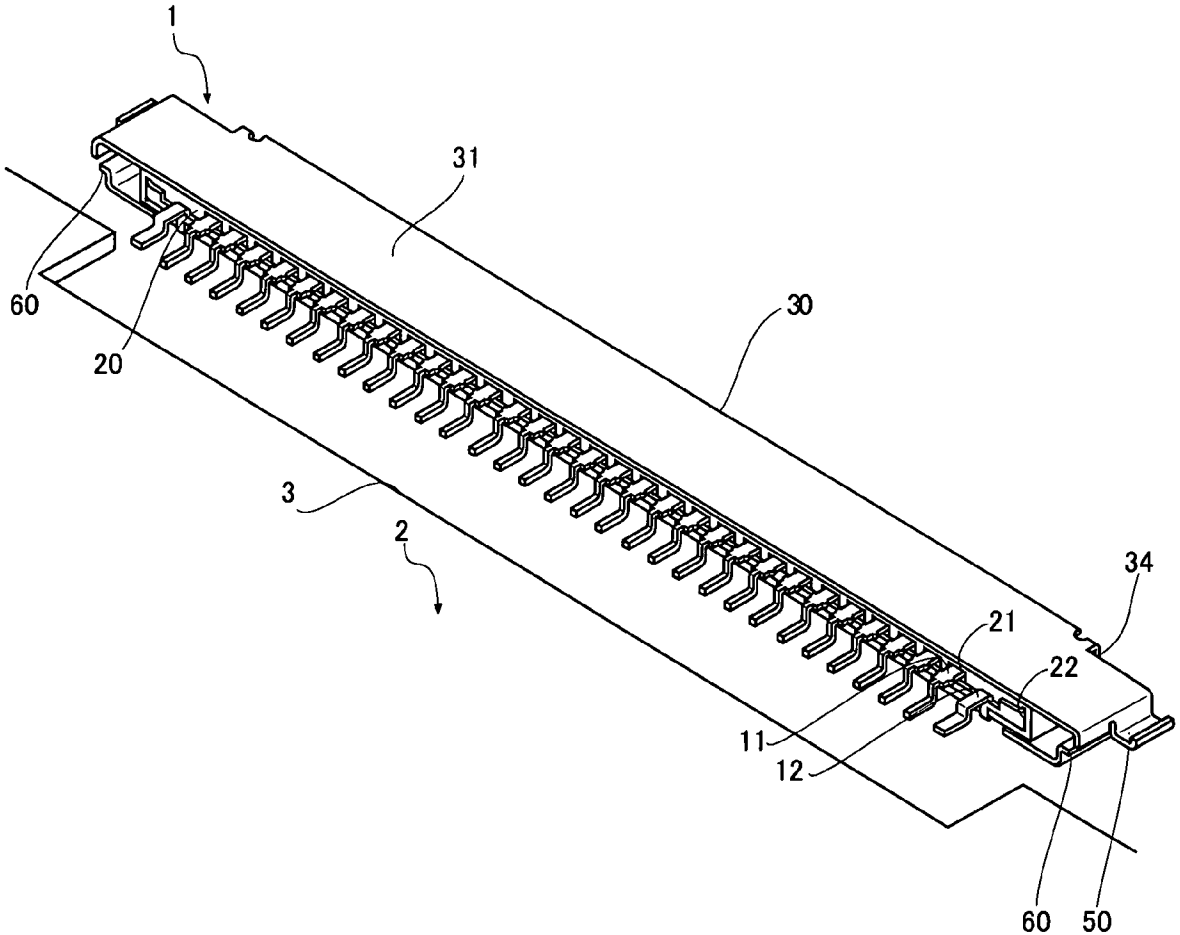
FIG. 2 is a rear oblique view showing the connector and the circuit board of FIG. 1.
Figure 3:
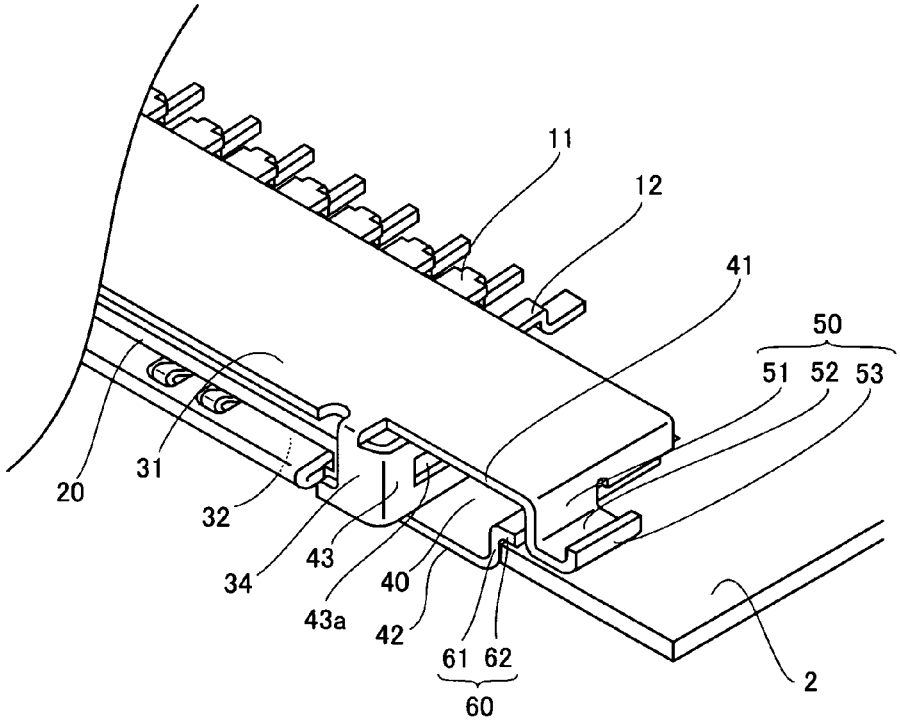
FIG. 3 is a partial, enlarged, oblique view of the connector of FIG. 1, the connector being mounted to the circuit board.

With reference to FIGS. 1 to 4, an electrical connector 1 according to an embodiment of the present invention is mountable to a circuit board 2. As shown in FIGS. 1 and 2, the circuit board 2 is formed with a recess 3 at an edge of the circuit board 2. As shown in FIG. 3, the electrical connector 1 is disposed within the recess 3 when mounted to the circuit board 2.

The illustrated electrical connector 1 and a cable connector not shown constitute a board-to-cable connector assembly, wherein the cable connector is a mating connector of the electrical connector 1 and for connecting cables to conductive patterns on the circuit board 2 through the electrical connector 1.

With reference to FIGS. 1 and 2, the electrical connector 1 comprises signal contacts 11, ground contacts 12, a housing 20 and a shell 30.

The illustrated housing 20 is made of non-conductive material such as resin. As shown in FIG. 1, the housing 20 has an opening at a fit end of the electrical connector 1 at which the electrical connector 1 is fit with the mating connector. As shown in FIG. 2, the housing 20 is also formed with holes 21 and holes 22. The signal contacts 11 are inserted into the holes 21, respectively, so that the housing 20 holds the signal contacts 11. The ground contacts 12 are inserted into the holes 22, respectively, so that the housing 20 holds the ground contacts 12.

The illustrated shell 30 is formed by stamping out a conductive mother plate, followed by bending the stamped plate. The shell 30 comprises an upper plate-like portion 31, a lower plate-like portion 32 and two connection portions 34 and has a fit opening 33. The fit opening 33 corresponds to the opening of the housing 20 and serves to receive and accommodate a fit portion of the mating connector therein. The connection portions 34 connect the upper and the lower plate-like portions 31, 32 at the fit end so that the fit opening 33 is positioned between the connection portions 34 in a longitudinal direction of the electrical connector 1.

With reference to FIGS. 1 to 4, the electrical connector 1 is provided with guide portions 40 at opposite ends thereof in its longitudinal direction. The mating connector is provided with guided portions. The guided portions are into the guide portions 40, respectively, when the mating connector is mated with the electrical connector 1.

Figure 4:
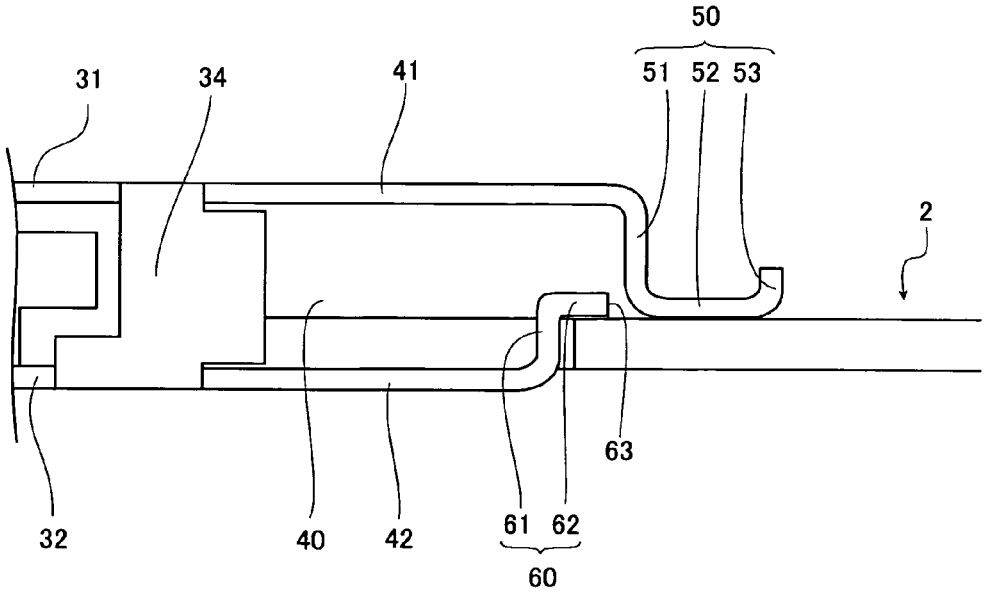
FIG. 4 is a partial, enlarged, front view of the connector of FIG. 3.

With reference to FIGS. 3 and 4, each of the guide portions 40 comprises an upper guide portion 41, a lower guide portion 42 and a guide wall 43. The upper guide portion 41 of the present embodiment is formed as an end section of the upper plate-like portion 31 in the longitudinal direction. The lower guide portion 42 of the present embodiment is formed as an end section of the lower plate-like portion 42 in the longitudinal direction. As shown in FIG. 3, the guide wall 43 is formed with an engagement hole 43*a*. On the other hand, the guided portion of the mating connector is provided with an engagement portion. When the electrical connector 1 is mated with the mating connector, the engagement hole 43*a* is engaged with the engagement portion to keep the mated state of the electrical connector 1 and the mating connector.

As shown in FIGS. 1 to 4, the upper plate-like portion 31 is provided with fixed portions 50 which are to be fixed to the circuit board 2 and are positioned at the outer ends of the upper guide portions 41 in the longitudinal direction. Each of the fixed portions 50 comprises first to third portions 51 to 53. The first portion 51 extends from an edge of the upper guide portion 41 downwardly. The second portion 52 extends from the first portion 51 horizontally and outwardly in the longitudinal direction. The third portion 53 extends from the second portion 52 upwardly. The second portions 52 are soldered to the circuit board 2 so that the upper plate-like portion 31 is fixed to the circuit board 2.

The lower plate-like portion 32 is provided with force resist portions 60 which are configured so that, when a downward force is applied to the electrical connector 1, the force resist portions 60 resist the downward force. In this embodiment, the force resist portions 60 are positioned at the outer ends of the lower guide portions 42 in the longitudinal direction. Each of the force resist portions 60 comprises a portion 61 and a hanger portion 62. The portion 61 extends from an edge of the lower guide portion 42 upwardly. The hanger portion 62 extends from the portion 61 horizontally and outwardly in the longitudinal direction.

When the electrical connector 1 is mounted to the circuit board 2, the illustrated hanger portion 62 rests on the circuit board 2 so that the hanger portion 62 hangs the lower plate-like portion 32 from the circuit board 2. The hanger portion 62 may be soldered to the circuit board 2.

In this embodiment, the second portion 52 of the fixed portion 50 and the hanger portion 62 are placed on the upper surface of the circuit board 2, i.e. the same surface of the circuit board 2 as each other. In addition, an edge 63 of the hanger portion 62 is positioned inside the first portion 51 of the fixed portion 50 in the longitudinal direction.

With the above-mentioned structure, even if the downward force is applied to the electrical connector 1, the lower plate-like portion 32 can resist the downward force.

In this embodiment, the hanger portion 62 is designed so that the hanger portion 62 rests on the circuit board 2 when the electrical connector 1 is mounted to the circuit board 2. However, the present invention is not limited thereto. The hanger portion 62 may be designed so that the hanger portion 62 is positioned above the circuit board 2 when the electrical connector is mounted to the circuit board 2, provided that, when the downward force is applied to the electrical connector 1, the hanger portion 62 is brought into contact with the circuit board 2 so that the hanger portion 62 hangs the lower plate-like portion 32 from the circuit board 2.

The second portion 52 of the fixed portion 50 and the hanger portion 62 may be placed on different surfaces of the circuit board 2 from each other. For example, the second portion 52 may be positioned on the upper surface of the circuit board 2, while the hanger portion 62 may be positioned on the lower surface of the circuit board 2. In this case, the hanger portion 62 is soldered to the lower surface of the circuit board 2.

The fixed portion 50 and the force resist portion 60 may have various shapes and/or may be arranged in a manner different from the above-mentioned embodiment. For example, the fixed portion 50 may be provided with an opening that is formed continuously in the first and the second portions 51, 52. In this case, the hanger portion 62 may have a particular shape, such as a protuberant shape, which is positionable within the opening of the fixed portion 50.

The present application is based on a Japanese patent application of JP2007-175518 filed before the Japan Patent Office on Jul. 3, 2007, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An electrical connector mountable to a circuit board, comprising:

contact pins;

a housing holding the contact pins;

a shell covering the housing at least in part, the shell comprising a first plate-like portion, a second plate-like portion and connection portions, the first plate-like portion extending in a predetermined direction, the second plate-like portion extending in the predetermined direction, each of the connection portions connecting the first and the second plate-like portion; and guide portions, into which guided portions of a mating connector are inserted when the mating connector is mated with the electrical connector, each of the guide portions comprising a first upper end portion and a second lower end portion, the first upper end portion; being formed as an end section of the first plate-like portion in the predetermined direction, the second lower end portion being formed as an end section of the second plate-like portion in the predetermined direction, the first upper end portion being provided with a fixed portion, the fixed portion being fixed to the circuit board, the second lower end portion being provided with a force resist portion, the force resist portion being configured so that, when a force is applied to the electrical connector along a direction from the first plate-like portion towards the second plate-like portion, the force resist portion resists the force, the force resist portion and the fixed portion being provided so that the force resist portion and the fixed portion are arranged in the predetermined direction, and the force resist portion is positioned inside the fixed portion in the predetermined direction;

wherein the circuit board has first and second surfaces, the fixed portion is fixed on the first surface when the electrical connector is mounted to the circuit board, wherein each of the resist portions is provided with a hanger portion which is placed on the first surface of the circuit board and hangs the second plate-like portion from the circuit board when the force is applied to the electrical connector; and wherein the hanger portions are fixed on the first surface of the circuit board when the electrical connector is mounted to the circuit board.

2. The electrical connector according to claim 1, wherein the hanger portion are fixed on the first surface by soldering.

3. The electrical connector according to claim 1, the circuit board being formed with a recess, wherein the electrical connector is disposed within the recess when mounted to the circuit board.

* * * * *

UNITED STATES PATENT AND TRADEMARK OFFICE

CERTIFICATE OF CORRECTION

PATENT NO. : 7,670,150 B2
APPLICATION NO. : 12/157744
DATED : March 2, 2010
INVENTOR(S) : Hisamatsu et al.

It is certified that error appears in the above-identified patent and that said Letters Patent is hereby corrected as shown below:

In Column 4, line 30, after "first upper end portion" please delete:
",".

Signed and Sealed this

Fifteenth Day of June, 2010

David J. Kappos

David J. Kappos
*Director of the United States Patent and Trademark Office*